United States Patent [19]

Otto

[11] 4,378,675

[45] Apr. 5, 1983

[54] HYDRAULIC PUMP INTERLOCK SYSTEM

[75] Inventor: Bernard Otto, Arlington, Tex.

[73] Assignee: Mobil Oil Corporation, New York, N.Y.

[21] Appl. No.: 224,980

[22] Filed: Jan. 14, 1981

[51] Int. Cl.[3] ..... F01B 25/02

[52] U.S. Cl. ..... 60/421; 137/567; 60/422; 91/6; 91/510

[58] Field of Search ..... 137/567; 60/421, 422; 91/6, 510

[56] References Cited

U.S. PATENT DOCUMENTS

| | | | |
|---|---|---|---|
| 3,720,059 | 3/1973 | Schurawski et al. | 60/421 |
| 3,922,855 | 12/1975 | Bridwell et al. | 60/421 |
| 4,112,821 | 9/1978 | Bianchetta | 91/6 |
| 4,213,300 | 7/1980 | Biskis | 60/422 |

*Primary Examiner*—Alan Cohan
*Assistant Examiner*—John A. Rivell
*Attorney, Agent, or Firm*—Charles A. Huggett; Michael G. Gilman; Frank J. Kowalski

[57] ABSTRACT

A hydraulic interlock system is disclosed wherein several pumps may be used to activate a plurality of hydraulic circuits while preventing activation of a single hydraulic circuit by more than one pump simultaneously.

2 Claims, 4 Drawing Figures

#1 PUMP ON, #2 PUMP OFF

#1 PUMP OFF, #2 PUMP ON

#1 PUMP ON, #2 PUMP ON

HYDRAULIC PUMP INTERLOCK SYSTEM

BACKGROUND OF THE INVENTION

The present invention pertains to interlock systems and more particularly to hydraulic interlock systems for use in pressurizing hydraulic circuits by one of several pumps while preventing pressurizing a hydraulic circuit by more than one pump.

Prior art has disclosed a variety of interlock systems, primarily in the electronic area. Several are available in the hydraulic drive field but, in general, they are complicated and have large space requirements. The present invention provides a simple, compact hydraulic interlock system which may be adapted for a wide variety of uses.

SUMMARY OF THE INVENTION

The present invention provides a system to prevent pressurizing a hydraulic circuit with more than one pump simultaneously. Electrically operated valves in conjunction with pressure operated valves are used to pressurize a pluarlity of hydraulic circuits when one pump is operating. Valves are controlled to provide the capability of a second pump to pressurize the same plurality of hydraulic circuits. When both the first and second pump are pressurizing, the valves operate to prevent both pumps from pressurizing an individual hydraulic circuit simultaneously.

DESCRIPTION OF THE PREFERRED EMBODIMENT

Figure 1:
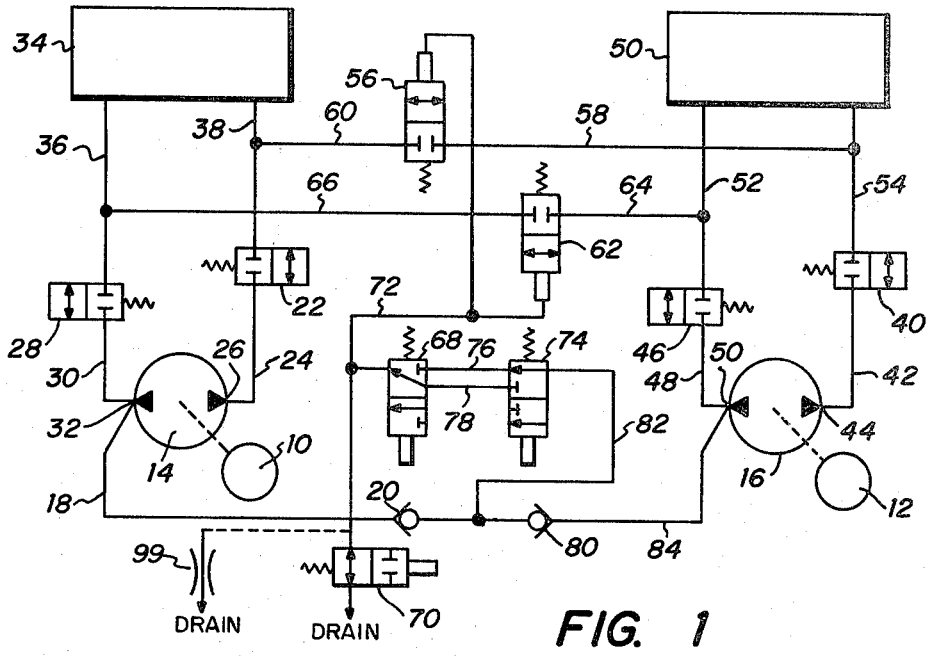
FIG. 1 is a hydraulic schematic drawing of the present invention.

Referring now to FIG. 1, the system of the present invention is illustrated as having electric motors 10 and 12 connected to drive pumps 14 and 16 respectively. Pump 14 delivers hydraulic control pressure at output port 32 through conduit 18 which is connected to check valve 20. Pump 14 is connected to valve 22 through conduit 24 at its input port 26. Pump 14 is connected to valve 28 through output conduit 30 at its exhaust port 32. Valve 28 is connected to hydraulic circuit 34 through conduit 36. Valve 22 is connected to hydraulic circuit 34 through exhaust conduit 38. Pump 16 is connected to valve 40 through input conduit 42 at input port 44 and connected to valve 46 through exhaust conduit 48 at output port 50. Valve 46 is connected to hydraulic circuit 50 through input conduit 52. Valve 40 is connected to hydraulic circuit 50 through exhaust conduit 54. Exhaust conduit 54 is connected to exhaust conduit 38 through valve 56 which has conduit 58 and 60 connected to conduits 54 and 38 respectively. Input conduit 52 is connected to input conduit 36 through valve 62 which has conduits 64 and 66 connected to conduits 52 and 36 respectively. Valves 56 and 62 are connected to control valves 68 and 70 through hydraulic line 72. Valve 68 is connected to valve 74 through conduits 76 and 78. Valve 74 is connected to check valve 20 and check valve 80 through control conduit 82. Check valve 80 is connected to pump 16 through control conduit 84 at output port 50.

In operation, valves 22 and 28 control fluid flow to hydraulic circuit 34 from pump 14 and valves 40 and 46 control fluid flow to hydraulic circuit 50 from pump 16. Pump 14 may also supply fluid flow to hydraulic circuit 50 through valves 56 and 62. Likewise, pump 16 may supply fluid flow to hydraulic circuit 34 through valves 56 and 62. Valves 68 and 74 supply the control hydraulic pressure to valves 56 and 62 from pumps 14 and/or 16. In practice valves 22 and 28 are preferably spring loaded closed and electrically operated to open. These valves are preferably connected into the motor starting circuit or motor 10 such that they will open when motor 10 is started. Valves 40 and 46 are similar to valves 22 and 28 and are preferably spring loaded closed and electrically operated to open when motor 12 is started. Valves 56 and 62 are also preferably spring loaded closed. However, they are preferably hydraulically operated valves which open when pressure is applied to their pilot ports. Valve 68 is preferably a three way two inlet two position valve which is spring loaded in the position illustrated in FIG. 1. Valve 68 is preferably electrically operated to its second position when motor 10 is started (see FIG. 2). Valve 74 is also a three way two outlet two position valve which is spring loaded in the position illustrated in FIG. 1. Valve 74 is preferably electrically operated to its second position when motor 12 is started (see FIG. 3). Valve 70 is used as a drain valve and is preferably spring loaded open and electrically operated to close when either motor 10 or motor 12 is started. Valve 70 is nonoperational if both motor 10 and 12 are on. Check valves 20 and 80 are inserted in between conduit 82 and pumps 14 and 16 to prevent charge flow, that is, pressure from one pump to the other.

Figure 2:
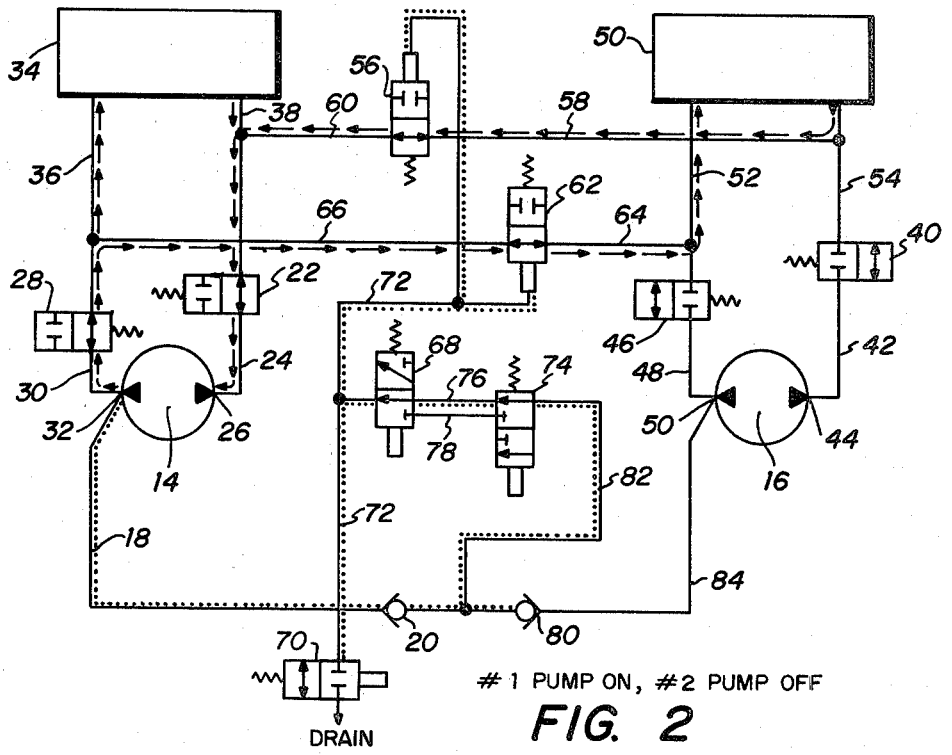
FIG. 2 is FIG. 1 with a first pump in operation.

Referring now to FIG. 2, the circuit of FIG. 1 is illustrated having pump 14 on and pump 16 off. With one pump operating, valve 70 is in the closed position preventing drainage of hydraulic control fluid. Valves 22 and 28 are in the open position. Valve 68 is in position to feed hydraulic control fluid through conduit 76 to conduit 72 which is connected to control valves 56 and 62 pushing them to an open position allowing fluid flow to travel from output port 32 of pump 14 through conduit 30 and through valve 28 to conduit 66 through valve 62 to conduit 64 which is connected to input conduit 52 of hydraulic circuit 50. Hydraulic circuit 50 has its exhaust conduit 54 connected to conduit 58 through the valve 56 to conduit 60 which is connected to outflow conduit 38. Outflow conduit 38 is connected to valve 22 which feeds input port 26 of pump 14 through conduit 24. Pump 14 also supplies fluid from output port 32 through valve 28 to input conduit 36 of hydraulic circuit 34. The output conduit 38 of hydraulic circuit 34 is connected to valve 22 which supplies a return path for pressurized fluid to input port 26 of pump 14 through conduit 24. Thus, when pump 14 is operating alone, it will supply pressurized hydraulic fluid to hydraulic circuits 34 and 50.

Figure 3:
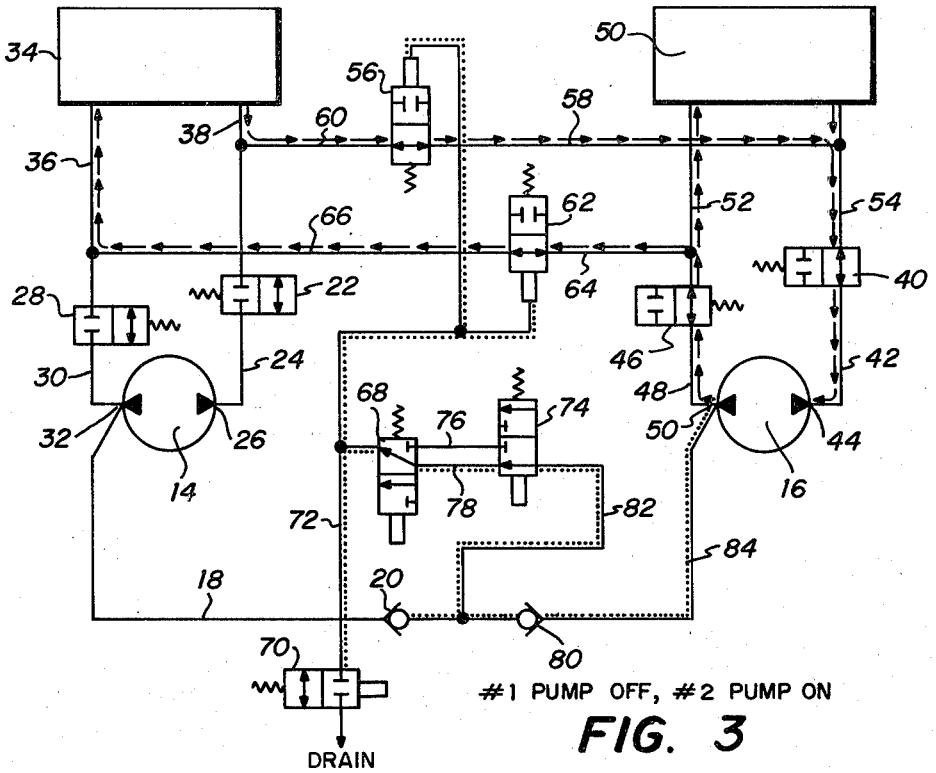
FIG. 3 is FIG. 1 with a second pump in operation.

Referring to FIG. 3, the circuit of FIG. 1 is illustrated as having pump 14 not in operation and pump 16 operating. Valves 40 and 46 are thus in the open position. Pump 16 supplies fluid pressure from its output port 50 through conduit 48 to valve 46. Valve 46 supplies fluid pressure to conduit 52 and conduit 64 which are connected to hydraulic circuit 50 and valve 62 respectively. Hydraulic circuit 50 is connected to return valve 40 through exhaust conduit 54. Return valve 40 is connected to the input port of pump 16 through conduit 42.

The fluid pressure from conduit 64 through valve 62 is supplied to conduit 66 which is connected to input conduit 36 of hydraulic circuit 34. Exhaust conduit 38 of hydraulic circuit 34 is connected to conduit 60 which is connected to valve 56. Valve 56 supplies the return fluid pressure to exhaust conduit 54 through conduit 58. As previously noted, conduit 54 is connected to valve 40 which is connected to input port 44 of pump 16 through conduit 42. Also, as indicated previously, when either pump 14 or 16 is in operation, valve 70 is closed to prevent drainage of hydraulic control pressure to valve 56 and 62. While pump 16 is operating, valve 74 is moved to a position connecting conduit 82 to conduit 78. Conduit 78 supplies fluid pressure to conduit 72 which opens valves 56 and 62.

Figure 4:
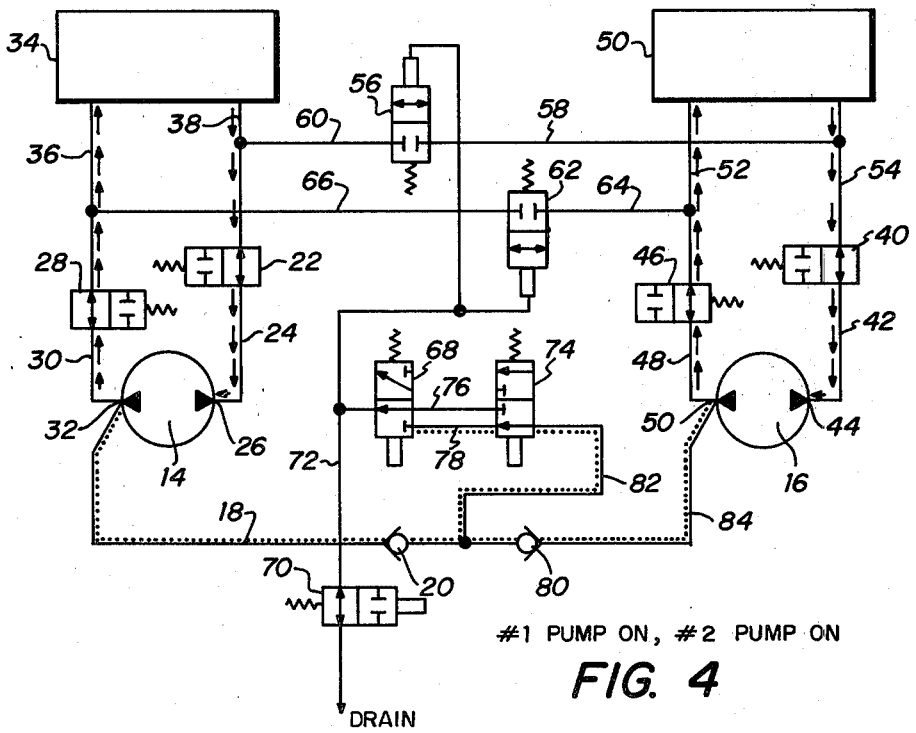
FIG. 4 is FIG. 1 with both pumps in operation.

Referring now to FIG. 4, the system of FIG. 1 is illustrated as having both pump 14 and 16 in operation. Valves 22, 28, 40 and 46 are thus open. Pump 16 supplies hydraulic fluid pressure from output port 50 through conduit 48 to valve 46. Valve 46 supplies fluid pressure to input conduit 52 of hydraulic circuit 50. Hydraulic circuit 50 is connected to return valve 40 through exhaust conduit 54. Valve 40 is connnected to input port 44, pump 16 through conduit 42, thus completing the fluid flow from pump 16 to hydraulic circuit 50. Output port 32 of pump 14 is connected to valve 28 through conduit 30 which supplies fluid pressure to input conduit 36 of hydraulic circuit 34. Hydraulic circuit 34 is connected to return valve 22 through exhaust conduit 38. Valve 22 is connected to the input port 26 of pump 14 through conduit 24. While both pump 14 and 16 are operating, drainage valve 70 is open to allow drainage of hydraulic control fluid through conduit 72. Valve 74 is connected to a valve 68 such that conduit 72 is isolated from conduit 82. Thus valves 56 and 62 remain in their steady-state position which is closed preventing communication of fluid flow between exhaust conduit 38 and exhaust conduit 54. With valves 62 closed, fluid communication between input conduit 36 and input conduit 52 is also prevented. Pump 14 will supply the hydraulic fluid pressure for hydraulic circuit 34 and pump 16 will supply the hydraulic fluid pressure for hydraulic circuit 50. Fluid flow lines are closed to prevent either hydraulic circuit 34 or hydraulic circuit 50 from receiving fluid pressure from both pump 14 and pump 16 simultaneously.

Valve 70 may be replaced by orifice 99 which allows a small (fluid) leakage out of conduit 72. Flow from conduit 82 through valves 68 and 74 is adequate to allow leakage through orifice 99 and keep valves 56 and 62 open. With flow blocked from conduit 82 to conduit 72, valves 56 and 62 will close because of loss of pressure through orifice 99.

The foregoing description of the preferred embodiment is by way of illustration only and the present invention should not be limited thereto but only by the scope of the following claims.

What is claimed is:

1. A hydraulic interlock to prevent simultaneous energization of a hydraulic circuit by more than one source while allowing energization by any one of a plurality of sources in a system having a first and second hydraulic source and a first and second hydraulic circuit, said interlock comprising:

a first valve means for controlling fluid flow connected to said first hydraulic source having a normally closed position and an open position whenever said first hydraulic source is in operation;

a second valve means for controlling fluid flow connected to said second hydraulic source having a normally closed position and an open position whenever said second hydraulic source is in operation; and a third valve means for controlling fluid flow between said first hydraulic source and said second hydraulic circuit and between said second hydraulic source and said first hydraulic circuit having a normally closed position and an open position whenever only one of said first hydraulic source and said second hydraulic source is in operation.

2. In combination:

first and second hydraulic source means for supplying pressurized fluid;

first and second hydraulic circuits, each connected to said first and second hydraulic source means;

first valve means for permitting fluid flow between said first hydraulic source means and said first and second hydraulic circuits;

second valve means for permitting fluid flow between said second hydraulic source means and said first and second hydraulic circuits; and third valve means connected between said first valve means and said second hydraulic circuit and between second valve means and said first hydraulic circuit for preventing fluid flow whenever both said first and second hydraulic source means are operating.

* * * * *